United States Patent [19]

Shanis

[11] 4,123,967

[45] Nov. 7, 1978

[54] AIR BARRIER DEVICE USING PRESSURIZED SWIRLS

[76] Inventor: Arnold A. Shanis, 64 Packard Ave., Hull, Mass. 02045

[21] Appl. No.: 804,522

[22] Filed: Jun. 8, 1977

[51] Int. Cl.[2] ..... F24F 9/00; F15D 1/02

[52] U.S. Cl. ..... 98/36; 138/37; 138/39

[58] Field of Search ..... 98/36; 126/99 C; 138/37, 39, 122, DIG. 4

[56] References Cited

U.S. PATENT DOCUMENTS

| | | | |
|---|---|---|---|
| 774,730 | 11/1904 | Van Kannel | 98/36 |
| 1,770,208 | 7/1930 | Kemnal | 138/38 |
| 2,715,321 | 8/1955 | Burger | 98/36 |
| 2,775,187 | 12/1956 | McClurkin | 98/36 |
| 2,898,942 | 8/1959 | Rothermel | 138/122 |
| 3,023,688 | 3/1962 | Kramer, Jr. | 98/36 |
| 3,157,105 | 11/1964 | Tamm et al. | 98/36 |
| 3,229,609 | 1/1966 | Larson et al. | 98/36 |
| 3,394,755 | 7/1968 | Morrison | 98/36 |

*Primary Examiner*—John J. Vrablik
*Attorney, Agent, or Firm*—W. R. Hulbert

[57] ABSTRACT

An air barrier device using pressurized swirls for creating an air curtain barrier across a building opening, such as a door or window, to reduce heat transfer and thereby reduce both winter and summer energy losses. The device comprises a housing with an air intake for mounting within the building above the opening to be protected, a number of air discharge ducts having internal means for whirling the air passing therethrough and arranged to discharge the air downwardly across the opening as a series of distinct adjacent, oppositely rotating, pressurized swirls to form an air curtain barrier to energy transfer in either direction through the opening, and a blower mounted in the housing to receive air from the intake and discharge it through the ducts.

6 Claims, 6 Drawing Figures

FIG. 1
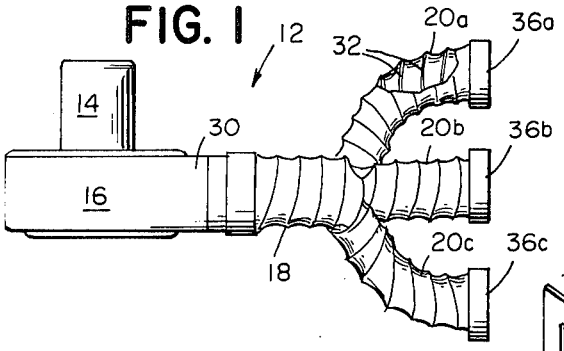
FIG. 2
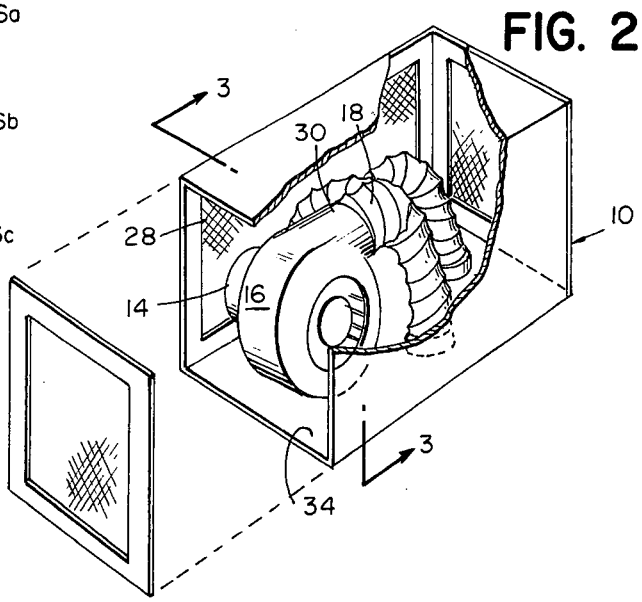
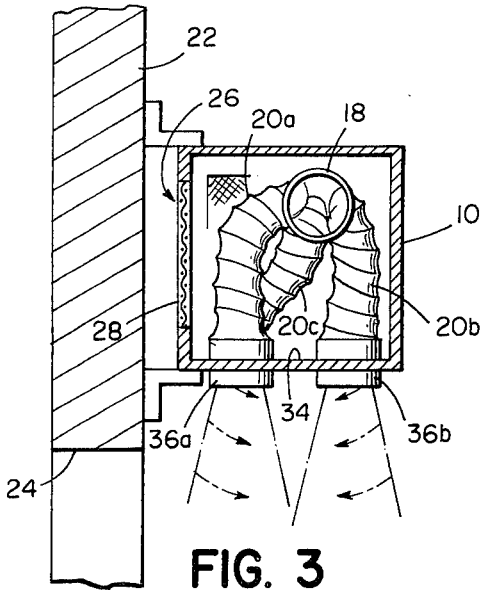
FIG. 3
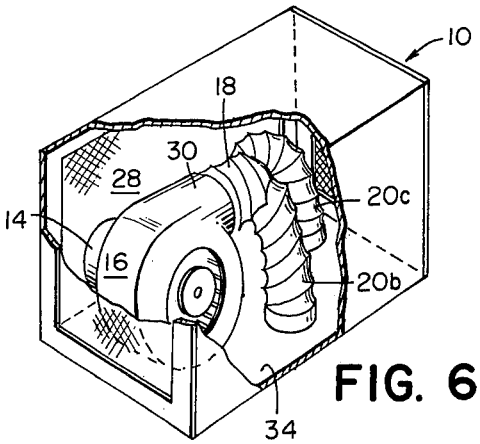
FIG. 6
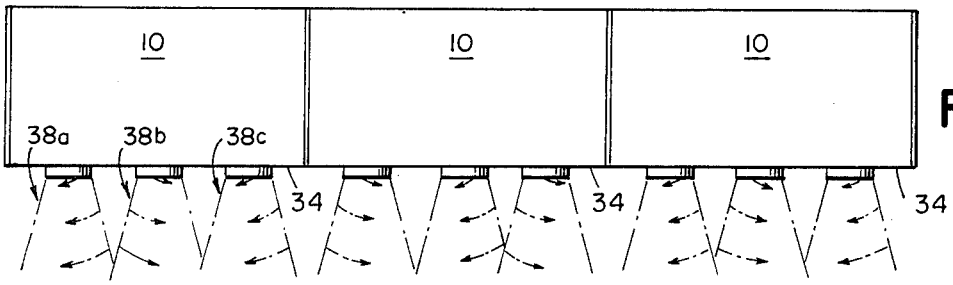
FIG. 4
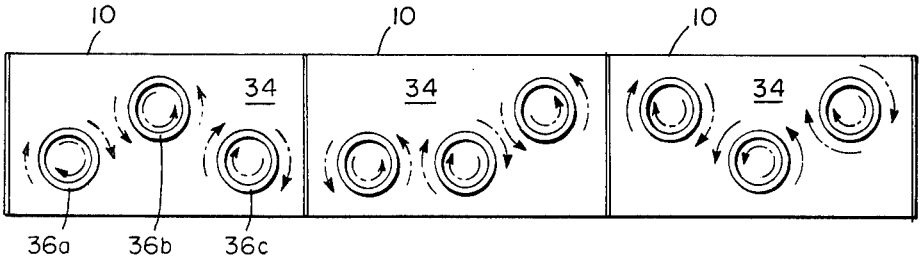
FIG. 5

AIR BARRIER DEVICE USING PRESSURIZED SWIRLS

BACKGROUND OF THE INVENTION

This invention relates to the production of air curtain barriers across building openings, such as doors and windows, to reduce both winter and summer energy losses.

It has heretofore been proposed to provide apparatus for accomplishing this result. See, for example, U.S. Pat. Nos. 3,059,563; 3,086,441; 3,156,641; 3,157,105; and 3,327,935.

The prior art devices, so far as I am aware, all attempt to produce a downwardly directed relatively homogenious sheet or layer of moving air across the opening in question, in the belief that such a sheet or layer would form the most effective barrier to energy transfer in either direction.

I have discovered that a more effective barrier comprises a series of side-by-side, preferably oppositely rotating, pressurized air swirls across such an opening. By its very nature, swirling air, like a whirlwind, tends to maintain its integrity and to resist disruption by outside forces. Side-by-side oppositely rotating swirls tend to reinforce each other, further to maintain their integrity and to resist disruption. The present invention employs these phenomena to great advantage in providing a much improved and more efficient barrier of the air curtain type.

SUMMARY OF THE INVENTION

In accordance with the invention, I provide an air barrier device using pressurized swirls for creating an air curtain barrier to heat transfer through door, window or like openings in a building comprising one or more housings adapted to be mounted within the building above the opening, an air intake in one or more of the housings, a plurality of air discharge ducts provided with internal means for whirling the air passing therethrough and arranged to discharge the air downwardly from each housing across the opening as a series of distinct adjacent pressurized swirls to form an air curtain barrier to heat transfer in either direction through the opening and one or more blowers mounted to receive air from the intake and propel it through the ducts. In preferred embodiments, I provide a plurality of housings, modular in nature each with a blower, and arranged to be mounted end to end; the discharge ducts comprise plenums receiving air from the blowers and a plurality of flexible, internally spirally ribbed conduits connected to the plenums and having their discharge ends pointing downwardly so as to direct a predetermined pattern of adjacent, oppositely rotating air swirls to form the air curtain barrier.

BRIEF DESCRIPTION OF THE DRAWINGS

FIG. 1 is a plan view of an individual blower-duct module which is adapted to be mounted in a housing above a building opening in the interior of the building;

FIG. 2 is a perspective, with portions broken away, showing the unit of FIG. 1 as mounted in a modular housing and with its air discharge conduits flexed to produce the predetermined pattern of air swirls;

FIG. 3 is a section on line 3—3 of FIG. 2 showing the unit of FIG. 2 mounted on an interior wall above a building opening;

FIG. 4 is an elevation showing three modules mounted side by side;

FIG. 5 is a bottom view of the units of FIG. 4 indicating directions of rotation of the discharged air columns; and FIG. 6 is a view similar to FIG. 2 of a module containing only two air discharge conduits.

DESCRIPTION OF PREFERRED EMBODIMENTS

The apparatus is designed to take in air at an elevated, usually ceiling, level within a building interior and discharge the same as a series of side-by-side distinct, pressurized swirls downwardly across an opening, such as a doorway, to form an air curtain barrier to passage of heat, as cold or heated air, in or out through the opening. To this end I provide one or more housings 10, one or more of which contains a blower unit 12 comprising electric motor 14, a blower 16, a plenum 18 and flexible air discharge conduits 20*a*, 20*b*, 20*c*, the housing being adapted for mounting on an interior wall 22 above a doorway 24, or other building opening to be protected. The blower 16 is preferably of the squirrel cage variety and has its intake in communication with interior building air at the level, usually ceiling level, at which the housing is mounted through one or more suitable openings 26, which may be provided with filters 28. The outlet 30 of the blower 16 is placed in communication with plenum 18 which, in turn, is in communication with flexible conduits 20*a*, 20*b* and 20*c*. Each conduit is provided with internal means (see FIG. 1), such as spiral ribs 32, to impart whirling motion in a predetermined sense to the pressurized air which emerges as adjacent swirling columns 38*a*, 38*b*, 38*c* as indicated by arrows in FIGS. 4 and 5.

The bottom of each housing comprises an appertured plate 34 whose openings fit connectors 36*a*, 36*b* and 36*c* whereby conduits 20*a*, 20*b* and 20*c* discharge their jets of whirling pressurized air downwardly in a predetermined, preferably triangular, pattern, as indicated generally in FIGS. 4 and 5, to form an air curtain composed of distinct, adjacent, oppositely rotating air swirls 38*a*, 38*b* and 38*c* sufficient in number to span the opening 12.

While the pattern of rotating air columns blanketing the opening is not critical, optimum results are achieved by having them sufficiently close to each other to minimize the passage of unwanted air currents through the curtain thus created. I have found that by swirling adjacent columns in opposite senses the columns tend to reinforce each other rather than to weaken each other, thus producing a curtain which can effectively shield an opening of substantial height with blowers of reduced power as compared with those which would otherwise be required. A preferred pattern is shown in FIGS. 4 and 5 where it will be seen that adjacent swirls rotate in opposite directions, as indicated by the arrows, thereby reinforcing their own integrity, and some swirls are closer to the plane of the wall than others, tending to produce a pattern of staggered, overlapping of swirls, and hence a more homogenious barrier.

Referring to FIG. 6, I have shown a unit, according to the invention, which is suitable for use over relatively narrow door openings. This unit employs only two spiral air conduits to produce a pair of counter-rotating downwardly directed adjacent swirls. Such a unit in use in New England during part of the winter of 1977 produced appreciable fuel savings thereby measurably reducing heating costs for the building in which it was used.

The pattern of side-by-side swirls thus produced retains greater integrity than a mere moving sheet or curtain of air and thereby resists to a greater degree the passage of colder or hotter air through the doorway or other opening, thus reducing substantially energy losses which would otherwise occur either in the case of heated buildings in the winter or air-conditioned buildings in the summer. The novel unit finds particular utility in locations where doors must be frequently opened or, indeed, left open most of the time, but it is also useful when mounted over the interior of large windows subject to high heat transfer. In this latter case the curtain of swirling columns of air bathes and warms or cools the glass and thus creates greater uniformity of temperature within the room.

It will be noted that by placing the air intake at ceiling level and directing swirls of such ambient air downwardly across the opening being protected, the unit is making use in wintertime of heated air which otherwise would be wasted. This is especially true of rooms with high ceilings wherein warm air rises to the ceiling. Optionally, of course, the intake to the blower could be placed in whole or in part in communication with a source of either heated or cooled air.

Due to the modular construction it is possible to mount any desired number of units of different lengths end to end and having different numbers of ducts to cover an opening of almost any size. Further, if desired, one large blower can be connected to supply air to any desired number of discharge conduits, within reasonable limits, so as to provide the desired number of side-by-side swirling air streams to cover openings of different widths. The housings may be designed in external appearance to be compatible with the interiors of the rooms wherein mounted. The units of the invention are suitable for installation in new construction or in existing buildings and, when once mounted, need only be plugged in and suitably electrically switched so as to be turned on and off.

What is claimed is:

1. Apparatus for creating an air barrier to energy transfer through door, window, or like openings, in a building comprising a housing adapted to be mounted within the building above the opening an air intake in said housing, a plurality of air discharge conduits provided with internal means for whirling the air passing therethrough and arranged to discharge said air downwardly across said opening as a series of distinct side-by-side pressurized swirls to form an air curtain barrier to energy transfer in either direction through said opening, and a blower mounted in said housing to receive air from said intake and discharge it through said conduits.

2. Apparatus as claimed in claim 1 including a plurality of said housings, modular in nature, and arranged to be mounted end to end.

3. Apparatus as claimed in claim 1 including a plenum receiving air from said blower and communicating with said conduits and wherein said conduits are flexible and internally spirally ribbed with their discharge ends pointing downwardly so as to produce a predetermined pattern of side-by-side air swirls to form said air curtain barrier.

4. Apparatus as claimed in claim 1 wherein said means for whirling the air is arranged to produce adjacent swirls rotating in opposite directions.

5. Apparatus as claimed in claim 3 wherein adjacent conduits are internally spirally ribbed in opposite senses so as to produce adjacent swirls rotating in opposite directions.

6. Apparatus as claimed in claim 5 including at least three conduits, at least one of said conduits being offset from the others so as to produce at least one generally triangular pattern of adjacent swirls.

* * * * *